US005183254A

United States Patent [19]

Jones

[11] Patent Number: 5,183,254

[45] Date of Patent: Feb. 2, 1993

[54] GAME TARGET OVERLAY FOR BILLIARD TABLE

[76] Inventor: Robert Jones, 5740 Longview Dr., LaGrange, Ill. 60525

[21] Appl. No.: 661,686

[22] Filed: Feb. 27, 1991

[51] Int. Cl.[5] ..... A63D 15/00

[52] U.S. Cl. ..... 273/14

[58] Field of Search ..... 273/2, 3 R, 3 A, 4 R, 273/4 C, 14, 128 R, 128 CS

[56] References Cited

U.S. PATENT DOCUMENTS

| | | | |
|---|---|---|---|
| 1,150,517 | 8/1915 | Hawks | 273/2 |
| 1,813,116 | 7/1931 | Clausen | 273/14 |
| 2,467,043 | 4/1949 | Kotler | 273/128 R |
| 2,900,189 | 8/1959 | Howlett | 273/128 R |
| 2,964,320 | 12/1960 | Lebrun | 273/128 |
| 3,114,547 | 12/1963 | Joslyn | 273/108 |
| 3,381,961 | 5/1968 | Wright | 273/128 R |
| 3,533,626 | 10/1970 | Smith | 273/128 R |
| 3,825,264 | 7/1974 | Doekum | 273/128 R |
| 3,889,945 | 6/1975 | Ellis | 273/128 R |
| 4,063,728 | 12/1977 | Zemanek | 273/14 |
| 4,120,494 | 10/1978 | Roe | 273/2 |
| 4,183,523 | 1/1980 | Hecht | 273/2 |

FOREIGN PATENT DOCUMENTS

| | | | |
|---|---|---|---|
| 15506 | of 1907 | United Kingdom | 273/2 |
| 7733 | of 1909 | United Kingdom | 273/14 |

*Primary Examiner*—Theatrice Brown
*Attorney, Agent, or Firm*—Potthast & Ring

[57] ABSTRACT

A portable game accessory to a billiard-type table with enclosing rails and a playing surface for playing a special game comprising a planar overlay which carries special game target indicia. The overlay has beveled edges which are sufficiently thin to enable a billiard ball to roll onto the upper surface of the overlay without significant deflection of the billiard ball. This accessory has for holding the overlay in a preselected one of a plurality of different possible positions relative to the enclosing rails on the playing surface against movement in response to the billiard ball rolling onto the upper surface.

19 Claims, 1 Drawing Sheet

Fig. 1
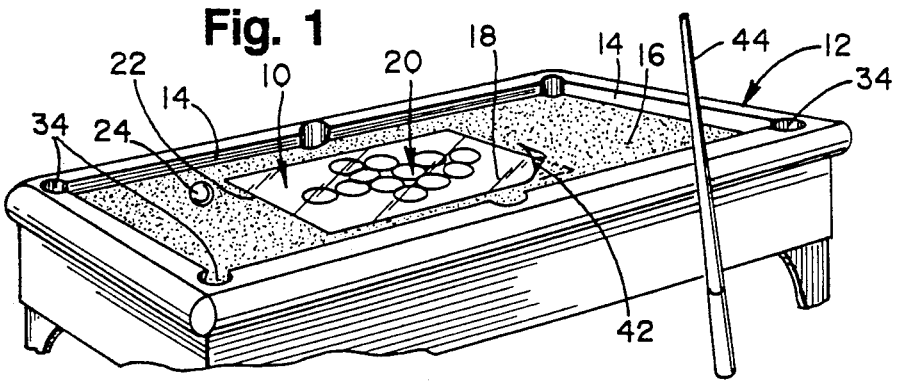
Fig. 5
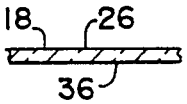
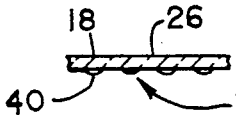
Fig. 3
Fig. 2
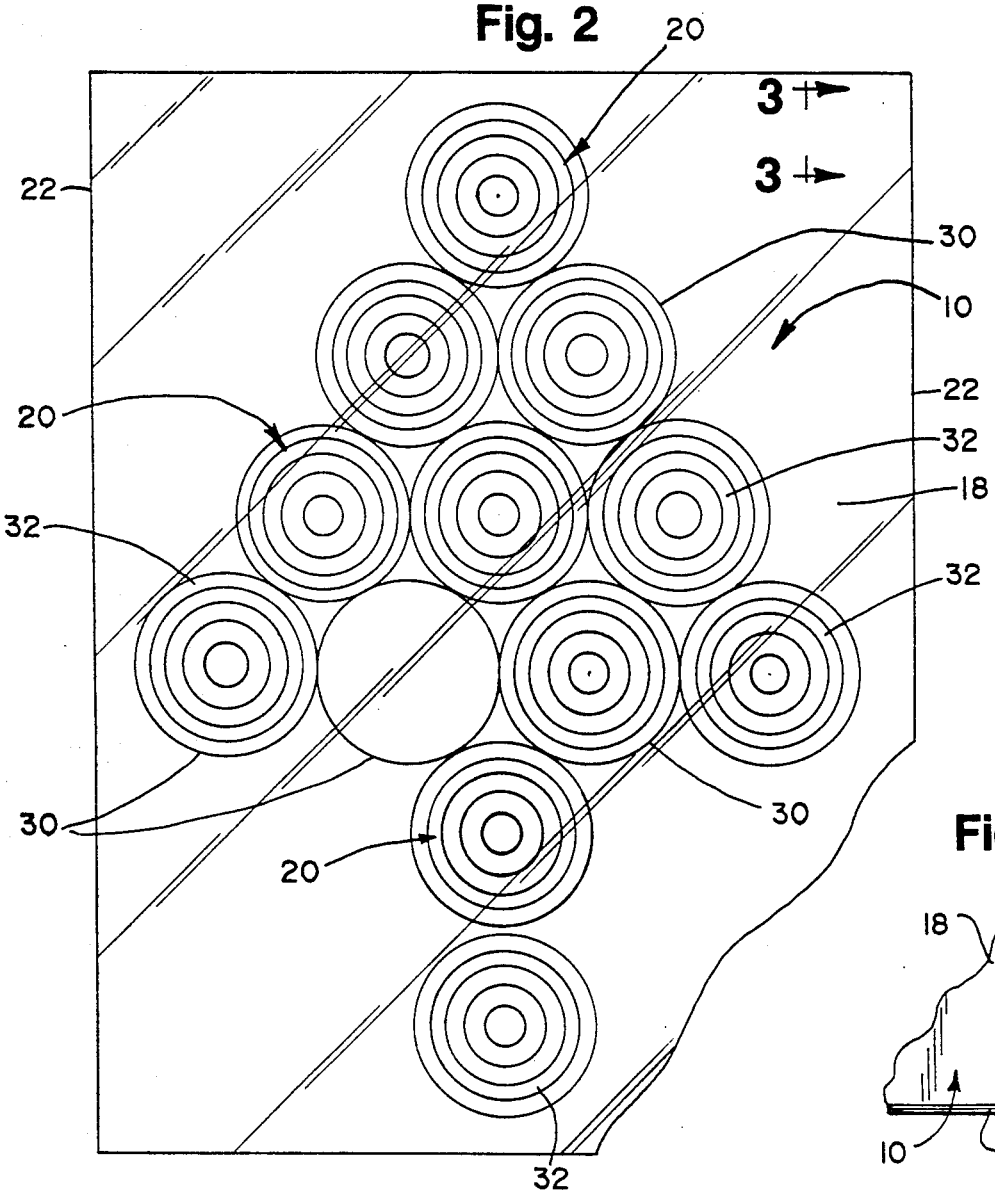
Fig. 4
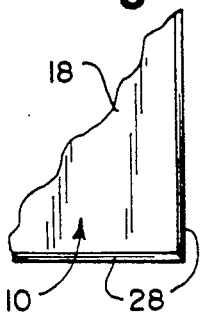

GAME TARGET OVERLAY FOR BILLIARD TABLE

BACKGROUND OF THE INVENTION

1. Field of the Invention

The present invention relates to game accessory to a billiard-type table for playing a special game and a method to use the same and more particularly, a portable planar overlay held in one of a possible plurality of different preselected positions on a billiard-type table surface in which a billiard ball is rolled onto the overlay.

2. Description of the Prior Art

Various assemblies are known which are used as table or set on ground surface games. However, none of these utilize a conventional billiard-type table or an overlay carrying target indicia which can be moved in various desired locations on such table. This can be seen in U.S. Pat. No. 567,177, to Waddell issued Sep. 8, 1896; U.S. Pat. No. 1,566,057 to Wilkinson issued Dec. 15, 1925; U.S. Pat. No. 1,845,531 to Terry issued Feb. 16, 1932; and U.S. Pat. No. 3,232,619 to Burk issued Feb. 1, 1966.

In U.S. Pat. No. 638,982 to Oliphant issued Dec. 12, 1899, a spring loaded roller is provided to secure a nonbilliardtype table overlay to one end of the table and a securement means is provided at the other end of the table thereby overlaying the entire surface of the table. No provision is set forth to place an overlay in preselected desired locations onto a billiard-type table surface and no provision is made for adequate thickness of edges to the overlay since the entire surface is covered of this table.

In U.S. Pat. No. 4,114,876 to Maruszak issued Sep. 19, 1978, movable obstacles are provided which have raised edges to deflect a billiard ball and hinder it from rolling up onto the surface of the obstacle. No target indicia is provided since this device is an obstacle, in fact, a basin is provided filled with sand which is not conducive to smoothly rolling a billiard ball over.

SUMMARY OF THE INVENTION

It is therefore an object of this invention to provide a portable game accessory to a billiard-type table for playing a special game. This game accessory has a planar overlay which carries special game target indicia. The overlay has edges which are sufficiently thin to enable a billiard ball to roll onto the upper surface of the overlay without significant deflection of the billiard ball. This accessory further provides a means for holding the overlay in a preselected one of a plurality of different possible positions on the table surface which will resist movement in response to the billiard ball rolling onto the upper surface of the overlay.

It is a further object of this invention to provide a method of using this portable game accessory to a billiard-type table. The method provides placing the planar overlay in a preselected one of a plurality of different possible positions relative to the rails of the billiard-type table. The next step is rolling a billiard ball over the playing surface of the table and onto the overlay to selected ones of the target indicia.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which:

FIG. 1 is a perspective view of the overlay lying on a surface of a billiard-type table with a corner of the overlay partially turned up displaying an embodiment;

FIG. 2 is a partial plan view of an embodiment of the overlay;

FIG. 3 is a partial cross section view of an embodiment of the overlay along line 3—3 as shown in FIG. 2;

FIG. 4 is a partial plan view of the embodiment of the overlay; and

FIG. 5 is a partial cross section view of an embodiment of the overlay along line 3—3 as shown in FIG. 2.

DETAILED DESCRIPTION OF THE DRAWINGS

Referring now to the drawings, portable game accessory 10 can be seen in FIG. 1, positioned on a standard billiard-type table 12. These are conventional tables such as pool or billiard tables or the like. Table 12 is enclosed with bumper or resilient rails 14. These conventional tables have playing surface 16 which are typically covered with felt cloth or other cloth type material.

Portable game accessory 10 is utilized on these billiardtype tables 12 but can be contemplated to be utilized on other structures of these types.

Portable game accessory 10 comprises in part a planar overlay 18 which carries special game target indicia 20. Edges 22 of overlay 18 are sufficiently thin to enable a ball such as a billiard ball 24 to roll onto upper surface 26 of overlay 18 without significant deflection of ball 24 from overlay 18. Typically overlay 18 will be a sheet of a thickness of the order of 10 mils. It is contemplated by this invention that varying range of thicknesses, thinner and thicker, than 10 mils will accomplish this objective. Other variations of edges 11 can accommodate various thickness by having bevel-like edges 28 as seen in FIG. 4. These bevel-like edges 26 can have a linear or curved surface which can assist ball 24 to roll onto upper surface 26 of overlay 18, without significant deflection. Bevellike edges 26 could be used with thinner or thicker overlays as desired to accomplish this result.

Overlay 18 is of a flexible material, however, this invention contemplates overlay 18 can be of a semi-flexible or rigid construction. However, a preferable construction is to have it sufficiently flexible to be easily rolled up for convenient storage. It has been found that plastic and vinyl materials and the like are desirable for overlay 18. However, other flexible materials or semi-flexible or rigid materials are contemplated and may be used.

Special game target indicia 20 are geometric FIGS. 30 which are visible from upper surface 26 of overlay 18. Geometric FIGS. 30 provide open areas onto which ball 24 may come to rest and thereby provide ability to determine scoring, tracking, etc. of various games which may include games such as golf, black jack, poker, etc. and many other games which contemplate point scoring and/or incremental steps or the like. Geometric FIGS. 30 can be of any regular and even irregular shape. Further, geometric FIGS. 30 can also have further subsections 32 for similar purposes. These subsections can likewise be of any regular or irregular open spaced configuration.

Target indicia 20 can be carried by overlay 18 in many conventional ways. A desired way is providing a thin layer of pigment such as ink, dye or paint or the like which adheres to overlay 18. Target indicia 20 can be merely outlined or can be partially or wholly coated in. Many other conventional ways of demarking target indicia 20 other than by applying pigment which will not significantly deflect or hinder ball 24 from rolling across surface 26 of overlay 18.

Overlay 18 may be transparent, translucent or opaque. When overlay 18 is transparent or translucent, target indicia 20 may be placed on either the upper surface 26 or the under side. The indicia 20 may very well be placed within overlay 18. Under these conditions, indicia 20 will be visible from the upper surface 26 of overlay 18. Should overlay 18 be opaque, indicia 20 will be carried on or in the upper surface 26 for the same purpose of being visible from upper surface 26.

As can be seen in FIG. 1, overlay 18 has an area less than the area of playing surface 16. This permits placing overlay 18 in a preselected one of a plurality of different possible positions on playing surface 16 relative to rails 14 or if it is a table with pockets 34, relative to those. This gives virtually unlimited positioning of overlay 18 on playing surface 16 giving the possibility of many different rules and games which can involve rails 14 or pockets 34 or both.

Since target indicia 20 are in fixed spatial relationship to each other, indicia remain in fixed relationship to one another no matter what position or location overlay 18 may be placed on surface 16.

Portable game accessory 10 also is comprised of a means for holding overlay 18 in a preselected one of a plurality of different possible positions on playing surface 16 against movement in response to billiard ball 24 rolling onto upper surface 16 of the overlay 18. Holding means can be accomplished in numerous ways such as the following and the like. A preferred holding means is utilizing a high enough density of material in overlay 18 sufficient to create a static frictional force between the underlying surface of overlay 18 and playing surface 16 which Will resist relative lateral movement of overlay 18 in response to rolling contact of billiard ball 24 over edges 22 or 28. Many conventional materials of adequate density for an overlay 18 thickness, in the order of 10 mils and the like, can create an adequate frictional force between the underlying surface of overlay 18 and playing surface 16. The underlying surface 36 for such holding means will be substantially flat as seen in FIG. 5. Other holding means can be a roughened underlying surface 38 as seen in FIG. 3. Roughened surface 30 can be bumps 40 or edges or serrations or the like which will frictionally engage playing surface 16 of table 12. Another holding means can be a contact adhesive 42 disposed on the underlying surface of overlay 18 to releasably adhere overlay 18 to playing surface 16 as seen in FIG. 1. Many conventional contact adhesives are available to provide adequate releasable securing and at the same time not cause severe damage to playing surface 16.

This invention further includes the method of using portable game accessory 10. This method includes placing planar overlay 18 in a preselected one of a plurality of different possible positions relative to rails 14 of billiard-type table 12 The method further includes rolling billiard ball 24 over playing surface 16 of billiard-type table 12 and onto planar overlay 18 to selected ones of target indicia 20.

This method can also include moving billiard ball toward target indicia 20 by first rebounding ball 24 off of rail 14 spaced from overlay 18.

This method can also include the step of striking ball 24 with cue 44 to start ball 24 rolling from a location on playing surface 16 spaced from overlay 18.

This method can also include the step of rolling ball 24 at a different desired target indicia 20 after rolling ball 24 at a desired target indicia 20. Many variations of rolling ball 24 at various targets is contemplated by this invention.

This method can also include the steps of placing overlay 18 in another preselected position on playing surface 16 relative to rails 14 after the steps of placing and rolling have been performed. This permits many variations in using this invention for various games and challenges.

While a detailed description of the preferred embodiment of the invention has been given, it should be appreciated that many variations can be made thereto without departing from the scope of the invention as set forth in the appended claims.

I claim:

1. A portable game accessory to a standard billiard table with enclosing rails and a playing surface for playing a special game, comprising:

a planar overlay having upper and lower planar surface and an area less than that of the playing surface carrying special game target indicia of geometric shape defining an area on at least one of said planar surface of the planar overlay in which a billiard ball is intended to land in the area for purposes of scoring in the game and in which the area is visible from the upper surface of the overlay said overlay having beveled edges which enable a billiard ball to roll up onto the upper surface of the overlay from the playing surface without significant deflection of a billiard ball; and means for holding the overlay in a preselected one of a plurality of different positions relative to the enclosing rails on the playing surface against movement in response to a billiard ball rolling onto the upper surface.

2. The portable game accessory of claim 1 in which the overlay is composed of a flexible material.

3. The portable game accessory of claim 2 in which the overlay is sufficiently flexible and may be roll up.

4. The portable game accessory of claim 1 in which the overlay is transparent.

5. The portable game accessory of claim 4 in which said target indicia is on said lower planar surface of the overlay.

6. The portable game accessory of claim 1 in which the overlay is translucent.

7. The portable game accessory of claim 6 in which said target indicia is on said lower planar surface of the overlay.

8. The portable game accessory of claim 1 in which the overlay is opaque and said indicia is on said upper planar surface.

9. The portable game accessory of claim 1 in which the overlay is plastic.

10. The portable game accessory of claim 1 in which the overlay is vinyl.

11. The portable game accessory of claim 1 in which the overlay has a thickness on the order of ten mils.

12. The portable game of claim 1 in which the target indicia comprise multiple geometric figures (visible from the upper surface of the overlay).

13. The portable game accessory of claim 12 in which some of the geometric figures are divided into subsections.

14. The portable game accessory of claim 1 in which said indicia is a thin layer of pigment adhered to the surface of said overlay.

15. The portable game accessory of claim 1 in which said standard billiard table has pockets and said overlay is positioned in one of a plurality of possible different preselected positions relative to the pockets.

16. The portable game accessory of claim 1 in which all said target indicia are in fixed spatial relationship to one another.

17. The portable game accessory of claim 1 in which said holding means includes material of said overlay of density sufficient to create a static frictional force between the underlying surface and the playing surface to resist relative lateral movement of the overlay in response to rolling contact of a billiard ball over said edges.

18. The portable game accessory of claim 1 in which the holding means includes an underlying roughened surface of said overlay which frictionally engages the surface of said table.

19. The portable game accessory of claim 1 in which the holding means comprises a contact adhesive disposed on said under surface of said overlay to releasably adhere said overlay to the table surface.

* * * * *